US007339478B2

(12) United States Patent
Le

(10) Patent No.: US 7,339,478 B2
(45) Date of Patent: Mar. 4, 2008

(54) METHOD AND APPARATUS FOR REMOTE CONTROL VEHICLE IDENTIFICATION

(76) Inventor: Michael Q. Le, 27572 Kathy Ct., Laguna Niguel, CA (US) 92677

( * ) Notice: Subject to any disclaimer, the term of this patent is extended or adjusted under 35 U.S.C. 154(b) by 212 days.

(21) Appl. No.: 11/053,311

(22) Filed: Feb. 7, 2005

(65) Prior Publication Data

US 2006/0087454 A1 Apr. 27, 2006

Related U.S. Application Data

(60) Provisional application No. 60/617,248, filed on Oct. 7, 2004.

(51) Int. Cl.
*G08B 13/14* (2006.01)

(52) U.S. Cl. ..... 340/572.1; 340/10.1; 340/539.13

(58) Field of Classification Search ..... 340/572.1
See application file for complete search history.

(56) References Cited

U.S. PATENT DOCUMENTS

| | | | | |
|---|---|---|---|---|
| 3,546,696 | A | 12/1970 | Waters et al. | |
| 3,714,649 | A | 1/1973 | Brouwer et al. | |
| 4,325,146 | A | 4/1982 | Lennington | |
| 4,449,114 | A | 5/1984 | Fascenda et al. | |
| 4,823,367 | A | 4/1989 | Kreutzfeld | |
| 4,857,886 | A | 8/1989 | Crews | |
| 5,090,030 | A | 2/1992 | Jenkins | |
| 5,140,307 | A * | 8/1992 | Rebetez et al. | 340/539.1 |
| 5,194,843 | A * | 3/1993 | Jones et al. | 340/323 R |
| 5,666,101 | A | 9/1997 | Cazzani et al. | |
| 5,734,315 | A * | 3/1998 | Skeen | 340/323 R |
| 6,380,863 | B1 | 4/2002 | Swoboda et al. | |
| 6,700,494 | B2 * | 3/2004 | Dowd | 340/573.3 |
| 6,744,403 | B2 * | 6/2004 | Milnes et al. | 342/357.07 |
| 2003/0016135 | A1 * | 1/2003 | Dowd | 340/573.3 |

* cited by examiner

*Primary Examiner*—George Bugg
(74) *Attorney, Agent, or Firm*—Don K. Harms

(57) ABSTRACT

An apparatus and method for automatically tracking each individual vehicle, of a plurality of vehicles, in a race around a track. The device employs RFID tags on each of the vehicles being tracked. The device employs RFID tags and a gate to energize the tag to broadcast the vehicle's identity when a pass through the gate is determined. The device can be employed to both track the individual vehicle participants in a race, and to register the participants before the race. Races can be tracked on different courses in different geographic locations by placing the RFID tags on all participants and tracking their progress on the individual remote tracks from a central location.

10 Claims, 1 Drawing Sheet

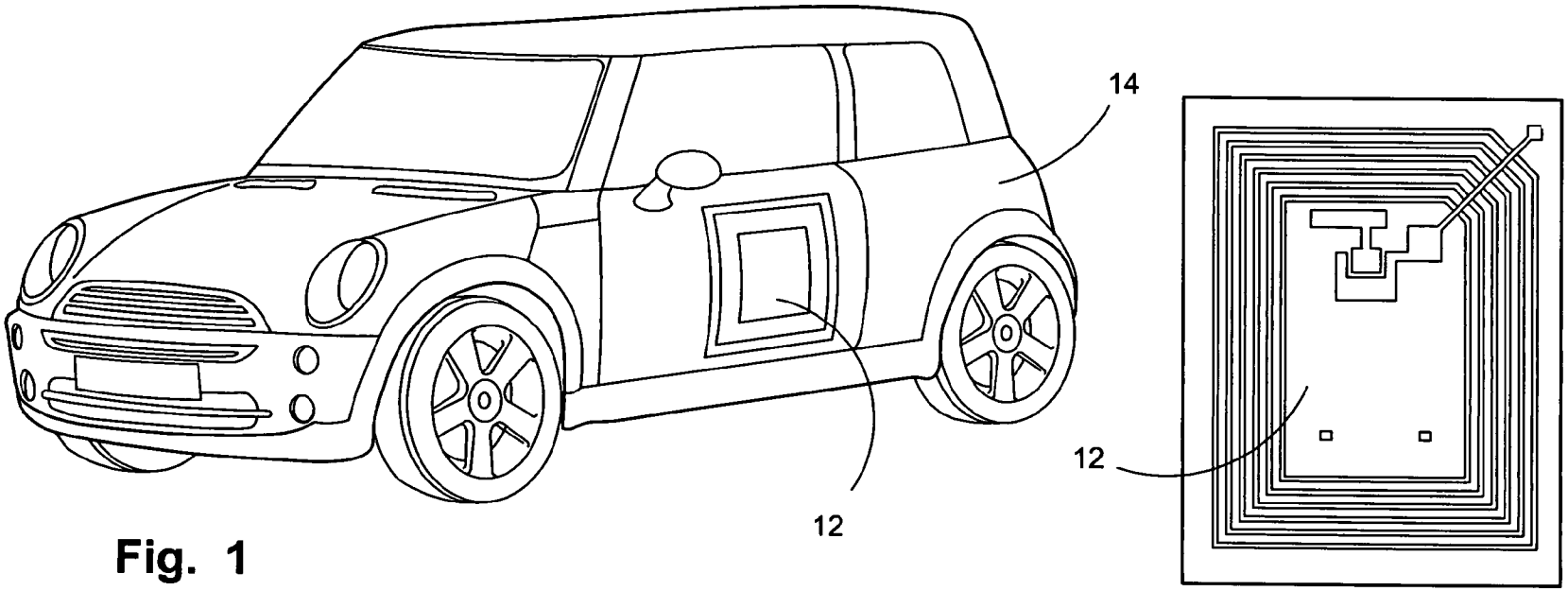
Fig. 1
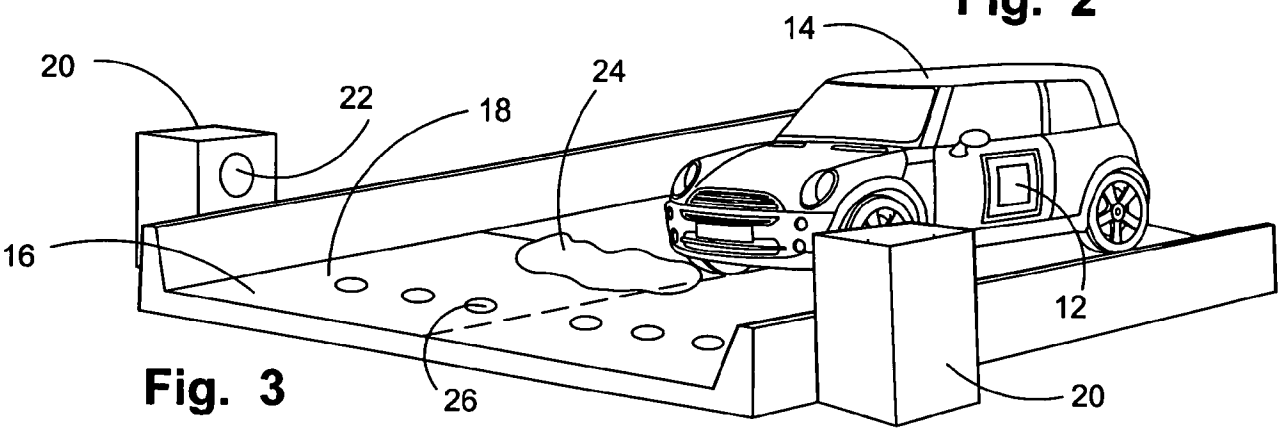
Fig. 2
Fig. 3

METHOD AND APPARATUS FOR REMOTE CONTROL VEHICLE IDENTIFICATION

This application claims priority from U.S. provisional application Ser. No. 60/617,248, filed Oct. 7, 2004.

BACKGROUND OF THE INVENTION

1. Field of the Invention

The present invention relates to vehicle racing. More particularly the device herein disclosed relates to a method and apparatus for the identification and tracking of vehicles used to race upon a defined track.

2. Prior Art

The racing of vehicles has been a popular sport since the dawn of the motor vehicle itself. Such races generally pit a plurality of vehicles against each other to complete a defined distance around a defined track in the fastest amount of time. As a general rule, the distance is a multiple of individual lengths or laps around a track of a determined length.

A vexing problem for such racing which has also been around since racing first began is the tracking of the vehicles in the race. This is because in order to determine which vehicle in the race has finished the defined distance first or in the shortest amount of time, the total number of laps must be computed as well as the total aggregate time it took the vehicle to complete the defined distance of the race.

In the early days, spotters actually watched the cars go past the starting line and counted the number of laps completed. This system was obviously prone to human error and cheating.

In recent years, with the advent of technologies to handle the task, a number of systems have been employed to track the vehicles in the race. There are four detection methods currently used on the market for lap counting.

A first such system involves the use of lasers and has been used primarily in model or slot car racing. This system employs a beam that is projected across the track at the finish line to a receiving device that senses the laser beam striking it. When a car crosses the laser beam, it blocks the laser light from hitting a sensor on the opposite side of the track and "counts" the crossing. The detector then communicates to a counter or computer that the beam has been broken which registers the crossing of a vehicle. Since slot car racers employ individual tracks or lanes for each racing vehicle, multiple lasers can be set up across each lane, or can be set at different heights to monitor more than one car at a time. If multiple cars are used, a flag must be attached to the antenna of each car (to block the laser light) at different heights corresponding to the height of each laser. However, this system has an inherent problem in that only a limited number of cars can be run at the same time because of the spacing required for the lanes and the length of the antenna. Another drawback to this system is that the laser poses a potential hazard to the users.

Another timing system by Lapz uses infrared transmitters and receivers. When a car passes underneath a structure that holds the infrared receivers, the receivers will detect the presence of infrared light emitted from a transponder that is connected to the vehicle. However, a problem with this system is that the transponder must be mounted on the car with a direct line of sight to the receivers which may be difficult in some vehicles. Additionally, because infrared detection is used, the background light radiation (since light produces infrared waves) can degrade the performance of the system. The transponders also require power from the vehicle to which they are mounted and are relatively large.

This precludes the use of this system in small scale vehicles such as the 1/64 scale ZipZaps which have small capacity batteries that cannot tolerate the extra power drain nor the extra weight of the transponder.

A third detection system for model or slot car racing from AMB also involves the use of a battery powered transponder device on each car. It has the same drawbacks relating to the size of the transponder as the previous system and the current draw which can slow the car or decrease its range.

In this system which is the standard system used by professional events such as NASCAR a wire pickup is placed underneath the track. When the car passes over the wire, the transponder's continuously broadcasting signal, broadcast on a specific frequency, is picked up by the wire and then processed by a receiver unit.

The communication is only one way in this system in that the transponder continuously emits its signal at the designated frequency allotted to the individual car, and the sensor pickup system is only used to receive the emitted signal. It is, of course, not well adapted to small battery powered or model racing due to the continuous current draw of the transceiver. Further, the required separation of frequencies on the radio band used limits the number of participants that can be tracked.

A fourth detection system from KoPropo detects the unique frequency that each radio-controlled vehicle produces. Each car uses a different frequency to allow multiple cars to be raced at a time. This system detects the unique frequency produced by a transmitter or by the motor in each vehicle. A piece of wire is put underneath the track to detect the individual frequency of each car that passes over it. Thus, the system requires no transponders if the unique motor RF transmission is tracked. However, this system can only detect a certain number of limited frequencies. The system must be customized or redesigned if the user wants to use a car that operates on a different frequency than the ones that come with the system.

In addition to the problems related to limited participant number and power drain, none of the systems noted above provide a means to remotely identify the vehicle being tracked. At best, each individual car is assigned some sort of identifier for the race which is broadcast when it passes the starting line or some other monitoring point. The identification is good for the individual race only and changes with each race. Consequently, the race participants must go through the time consuming process of registering at each race event for each race around the given track. Because each individual track has their own identifiers, it precludes having remote races with remote participants competing around different tracks since there is no common manner to identify the cars on the tracks.

SUMMARY OF THE INVENTION

The device and method herein disclosed provides timing, aggregate distance tracking, and universal identification of race cars participating in a race or participants in any type of race with one or more venues running a concurrent race. The device stores information about each participant onboard the racing vehicle by employing a tag with stable memory or optically readable bar codes encoded with information about the vehicle and its owner.

The preferred embodiment employs a tag or label with onboard memory such as an RFID tag to hold participant information. RFID stands for Radio Frequency Identification. It is also referred to as EID or electronic identification.

An RFID tag consists of a microchip or similar memory means to store data which is attached or communicates with an antenna.

RFID tags are developed using a radio frequency according to the needs of the system including read range and the environment in which the tag will be read. RFID tags may be active and use small amounts of onboard or available electrical power or in the current favored mode they can be passive, meaning they do not require a battery for operation. Such passive RFID tags require no power to operate in that they are energized by a reader when placed sufficiently close to it using a magnetic field that generates current in the tag for a concurrent broadcast from the tag. Active RFID tags, on the other hand, must have a power source and may have longer ranges and larger memories than passive tags as well as the ability to store additional information sent by the transceiver. Passive tags have an unlimited life span since they have no battery or power which might degrade over time. At present, the smallest active tags are about the size of a coin. Many active tags have practical ranges of tens of meters and a battery life of up to several years so they might also be used where weight is not an issue.

Each RFID tag can be visually read or electronically read with a remote RFID reader enabling the transfer of information programmed into the memory of the RFID. This information might be as simple as an identifier such as a number or arrangement of letters, of the RFID itself, which may be associated with the car and owner by a relational database. Or, the RFID may be encoded with more information which is held in programable memory which might include information about the specific car on which it is mounted, its owner, and other relevant stored information to be transmitted quickly and accurately.

RFID technology eliminates the need for "line of sight" reading. The tags can be mounted on the exterior of the cars or internally since RFID communication easily penetrates through wood, plastic, and even thin metal. Currently, there are four different kinds of tags commonly in use, their differences based on the level of their radio frequency: Low frequency tags (between 125 to 134 kilohertz), High frequency tags (13.56 megahertz), UHF tags (868 to 956 megahertz), and Microwave tags (2.45 gigahertz). However, frequencies can be any allowed by the FCC.

In use the RFID tag with its onboard memory would be programed, preferably by a central authority for that racing circuit. In the case of slot car and model racing, the association or authority which sponsors the different regional races would receive information about the entrant and program the RFID with data to identify it during one or more future races. Such information can be a simple unique identifier or can include information about the car, its owner, and any other relevant information desired. This information unique to the individual RFID would be programed into a specific RFID tag which would be given to the car owner for mounting on the car.

Where entrant and car information is programed in such a pre-registration scheme there can be two purposes. First, when the car is racing, the RFID tag will broadcast the onboard data or information enabling the race officials to easily gather information about the times and distances traveled by the various racers participating. Second, by programming all of the owner and/or car and/or other desired participant information into the individual RFID components in a standardized fashion, registering for each race will be as simple as placing the participant's car close enough to a tag reader to energize the tag which will simply transmit the information to a computer tracking the participants. No forms or other writing would be required for the participants to enter.

In use during a race, a sensing or trigger means such as one which would sense when individual cars cross a point on the track such as the finish line, would be employed. This can be done using light beams or proximity detectors or other means to sense the movement of a car past a designated point, so long as relatively accurate location of the car on the track is achieved. When a crossing of the gate or point being monitored is sensed, the RFID, in the case of a passive RFID, would be energized to transmit its encoded data. Each time the car passes the point being monitored the information is automatically transmitted. If the RFID is active, then a small receiver would sense the passing of the point and activate the RFID to transmit. The receiver would receive a signal similar to that which would provide power to the passive RFID and initiate the communication.

The gate might also be a directional signal with a short distance of transmission broadcast at the point of monitoring. The signal would be continuous and since the RFID tags only broadcast the programmed information when they receive the energizing signal, they would only report the car when it passed the point of the continuous broadcast.

At a location either adjacent to the track or remote from the track, depending on the strength of the signal generated by the RFID, a computer would keep track of the participants' progress in the race. Since the system is not dependant on parsing out a narrow radio spectrum to participants, nor is it dependant on the physical aspects of the track limiting visual aspects like other systems, the number of participants that can be concurrently tracked is infinite. Further, the system would allow for "virtual races" to be held at different locations by employing identical tracks for participants to race upon, all with tag readers to track the participants and communicate the times and distances of the remotely located participants to a central tracking station. In this fashion a race could be held concurrently in New York and Los Angeles using cars equipped with the identification tags all racing on identical tracks. An unlimited number of tracks and cars can be monitored since the tags are individual to each participant and can be tracked concurrently irrespective of the amount of radio spectrum available.

With respect to the above description above, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Also, while the description above describes the use of the system in an automotive race, the device and system could also be employed in any race where there are a plurality of participants such as a running race or a NASCAR race or any other race. It would be especially useful for such races of participants which are run concurrently on different tracks at different geographic locations to track all of the individual participants and determine a winner. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

An object of this invention is to provide a device and method to passively track participants in a vehicle race.

Another object of this invention is the provision of a device and method to track such participants in model car races.

A further object of this invention is providing a device and method to register participants in races without the need for paper or writing, by programming the relevant information into a tag on the car being raced.

An additional object of this invention is the provision of such a car tracking device that will allow for unlimited concurrent participants irrespective of the radio frequency used for monitoring.

Yet an additional object of this invention is the provision of such a car tracking and monitoring device and method that will allow for concurrent races between entrants at different geographic locations on similar tracks.

Further objects of the invention will be brought out in the following part of the specification, wherein detailed description is for the purpose of fully disclosing the invention without placing limitations thereon.

BRIEF DESCRIPTION OF DRAWING FIGURES

FIG. 1 is a perspective view of the device showing an RFID tag on a car.

FIG. 2 depicts RFID tags in decal or adhesive backed form ready for application to a car.

FIG. 3 shows a side perspective view of the monitoring point on a track which activates transmission of the RFID.

DETAILED DESCRIPTION OF THE PREFERRED EMBODIMENTS OF THE INVENTION

Referring now to the drawings, FIGS. 1-3 depict the components of the system employed for remote control vehicle identification and tracking. These components may also be used in the registration system for race participants on a local or national scale. In addition to tracking the entrants in a race around a single race track, the device and system may also be used to track the individual racers and cars at a plurality of venues having substantially identical tracks. Essentially, using substantially identical or equal distance racetracks, located at remote venues, the racers could race against each other and the system would track the progress of the various entrants around the various tracks to determine the winners.

In use the RFID tag 12 would have an onboard memory capability employing a microchip or other memory storage device which uses either programable memory or read only memory that would programed with the car's identity along with the owner and any other pertinent information needed to track the car during the course of races it might enter. The RFID tag 12 and data in its memory would then be affixed to the car at an operable location to be energized. A programable memory scheme would work best for remote registration of the entrants since a wand or other broadcast type programmer could input the pertinent information into the RFID tag 12.

In the case of slot car and model racing, the association or authority which sponsors the different regional races would receive the information about the car, its owner, the other relevant information during a registration process and program that information into, or associate it with, a specific RFID tag 12 which would be given to the car owner for mounting on the specific car 14 to be raced.

In use, a trigger to determine passage can be employed in the form of a sensing means such as a light beam 22 that would be broken by a car 14, a buried wire loop 24 that would sense passage overhead, or buried light projectors 26 which would sense a passing car 14. Or, the RF or EMF transmitters 20 at the gate 18 providing the energy for the passive RFID 12 could be the simple means to trigger signal of passing through the gate 18 by simply energizing the RFID 12 to transmit. Or a combination of the above means to trigger a signal the car 14 has passed the gate 18 could be used. Further, as those skilled in the art will no doubt realize, other means to trigger a signal the car 14 has passed a gate 12 or point on the track being measured could be used and such are anticipated to determine when individual cars or participants in any other type of race cross a point on the track such as the finish line. Consequently, determining the crossing of a point on the track can be done using light beams or proximity detectors or RF or other means for triggering a pass through the gate so long as relatively accurate location of each car 14 on the track 16 is achieved.

When a crossing of the gate 18 or point being monitored is sensed, the RFID 12, in the case of a passive RFID, would be energized to then transmit data stored which is related to that individual RFID 12 which would be communicated to a receiver on the appropriate frequency and at an appropriate distance from the car to receive and process the transmission.

Each time the car passes any gate 18 or point on the track being monitored, the information programmed into or associated with that individual RFID 12 is automatically transmitted. If the RFID 12 is active and has onboard electrical power, then a small receiving device on the car in communication with the RFID 12 would sense the passing of the point and activate the RFID 12 to transmit. If it is passive, an appropriate energy field would be concurrently formed adjacent to the RFID to cause a transmission by the passive RFID 12 of onboard information associated with the individual car 14 to which the RFID 12 is affixed. Data transmitted from an active RFID 12 would, of course, be the same or similar to the data from a passive RFID 12 once communication is initiated.

The gate 18 might also be a directional signal with a short distance of transmission broadcast at the point of monitoring. One or a plurality of RF or EMF transmitters 20 would energize the gate 18 providing a continuous source of energy to energize the passing RFID 12. Since the RFID tags only broadcast the programmed information when they receive the energizing signal, they would only report the car 14 when it passed through or over the point of the continuous broadcast adjacent to the gate 18 tracking cars therethrough. In a close race, it may be advantageous to employ some sort of light beam as noted above in case two cars 14 pass through the gate 20 in close proximity and the frontrunner must be determined.

As noted above, at a location either adjacent to the track 16 or remote from the track 16, depending on the strength of the signal generated by the RFID 12, a computer communicating with a receiver on the frequency of the broadcasting RFID's 12 would keep track of the individual participants' progress in the race.

An unlimited number of tracks and cars can be monitored at an unlimited number of locations since the RFID 12 tags are individual to each individual participant and can all be tracked concurrently irrespective of the bandwidth of radio spectrum available.

Using the components of the tracking system thereby provides a method to track each of the individual participants in a race, and they may be concurrently employed to register the participants in one or more races on the circuit during one or more racing seasons. The system as noted can also track multiple cars 14 at multiple geographic venues with similar or identical tracks to thereby have races concurrently between many participants in many different locations around the globe.

The device may be used in conjunction with a method of registration using the steps of programming all of the owners and cars and any other required information into the RFID 12 in a standardized fashion, employing an RFID reader to read the programmed information at each race site, communicating the read information to a computer, and recording the registrants and individual cars for the individual race based on the information stored in the RFID. This can be done by simply passing the cars through a gate or other point that will trigger the RFID 12 to transmit its data and will eliminate paper and writing to register the participants.

Once registered, the device and system can be employed to track the cars 14 or participants in a race on one or a plurality of race tracks. The above steps would be used to register the entrants by associating broadcast data from the RFID's 12 on each car with that specific car. Then, the cars may be tracked in each race by the additional step of monitoring the participant cars during the term of the race for passing through a gate 20 and the step of adding the aggregate number of passes through the gate 20 to determine the winner based on distance traveled and/or time of the travel of the cars being tracked over the determined race track course. As noted, races between participants could occur at one or a plurality of venues with the same or similar tracks and the data of cars 14 passing through gates 20 similarly situated on the similar tracks would be fed through a network to a central computer which would employ software to track all the participants over the course of the race. If the race were only at one track, the network would not be necessary since the tracked cars 14 would be on site.

While all of the fundamental characteristics and features of the present invention have been described herein, with reference to particular embodiments thereof, a latitude of modifications, various changes and substitutions are intended in the foregoing disclosure, and it will be apparent that in some instances some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention.

What is claimed is:

1. A system for automatically tracking each individual vehicle of a plurality of toy vehicles in a multiple lap race around a track, comprising:

said race conductible at a plurality of substantially similarly configured said tracks;

an RFID tag having an electronic memory for storage of the identity of said vehicle, said RFID tag mountable on said vehicle;

said RFID tag having means for RF transmission of said information;

at least one gate on each said track having a transmitter, said transmitter located adjacent to a toy race track on which said vehicle is raced;

said transmitter emitting sufficient EMF to energize said RFID tag to an energized state only when in close proximity to said gate;

said RFID tags emitting an RF transmission of said identity information only when in said energized state;

means for receipt of said information contained in said RF transmission from said RFID tags;

a computer communicating with said means for receipt of said information said computer communicating with a computer network; and software resident in said computer, said software providing a means initially identify each said vehicle from said information, at each said track, to thereby compile a list of participants in each said multiple lap race at each said track and to track the progress of each of said individual vehicles in said plurality of vehicles in each said multiple lap race by adding an aggregate number of passes past said gate to thereby determine a leader, based on said information received by from each said means for receipt of said information.

2. The system of claim 1 additionally comprising:

means for determining passage of said vehicle past said gate on said track;

said transmitter activated to transmit said EMF by said means for determining passage of said vehicle only when said vehicle passes said gate.

3. The system for automatically tracking each individual vehicle of a plurality of vehicles in a race around a track, of claim 1 additionally comprising:

said race conducted concurrently at a plurality of tracks;

each of said tracks being substantially similar to the other;

a network communicating said information from each respective means for receipt of said information, to said computer; and said software providing a means to initially identify each said toy vehicle from said information, to thereby compile a list of participants in each respective said multiple lap race and to remotely track the progress of each of said individual vehicles in said plurality of vehicles on each of said plurality of tracks to thereby determine said leader, based on said information received by said computer over said network from each respective means for receipt of said information.

4. The system for automatically tracking each individual vehicle of a plurality of vehicles in a race around a track, of claim 2 additionally comprising:

said race conducted concurrently at a plurality of tracks; and each of said tracks being substantially similar to the other;

a network communicating said information from each respective means for receipt of said information, to said computer; and said software providing a means to initially identify each said vehicle from said information, to thereby compile a list of participants in each respective said multiple lap race and to remotely track the progress of each of said individual vehicles in said plurality of vehicles on each of said plurality of tracks to thereby determine said leader, based on said information received by said computer over said network from each respective means for receipt of said information.

5. A method for registering and automatically tracking a plurality of vehicles in a race conductible at one or a plurality of similarly configured race venues having substantially similar tracks, comprising:

programming information relating to at least the identity of a vehicle into an RFID tag attachable to each said vehicle;

compiling a table of all said vehicles and their respective said identity associated with each said individual RFID tag;

attaching said RFID tag to said vehicle;

employing an RFID reader to read the programmed information at each race venue;

communicating the programmed information to a computer; and employing software resident on said computer to look up said respective identity associated with said RFID tag and compose a list of participants in each race.

6. The method of claim 5 additionally comprising the steps of:

employing said RFID reader adjacent to a reading point on a track on which said race is run;

reading said programmed information on individual RFID's engaged upon each of a plurality of individual vehicles in a multiple lap race as they pass said reading point;

communicating said programmed information to said computer; and employing software on said computer to track the progress of said race by adding an aggregate number of passes past said reading point to thereby and to determine a winner.

7. The method of claim 6 additionally comprising the steps of:

running said race on a plurality of different tracks having a substantially equal configuration;

employing an RFID reader adjacent to the same reading point on each of said plurality of tracks on which said race is run;

reading said programmed information on individual RFID's engaged upon each of a plurality of individual vehicles on said plurality of different tracks engaged in a race, as they pass said respective reading point;

communicating said programmed information to a remote computer; and employing software on said computer to track the progress of said race and to determine a winner from the plurality of vehicles on said plurality of tracks.

8. A system for automatically tracking each individual participant of a plurality of participants in a multiple lap race of toy cars around a track, comprising:

said race conductible at one or a plurality of substantially similarly configured tracks;

an RFID tag having an electronic memory for storage of information, said information associated with the identity of each participant in said multiple lap race, said RFID tag mountable on said participant;

said RFID tag having onboard means for emitting an RF transmission of said information;

a transmitter located at a reading point on each said track, said transmitter located immediately adjacent to the track on which said vehicle is raced;

said transmitter emitting sufficient EMF to energize said RFID tag to an energized state only in an area immediately adjacent to said reading point;

said RFID tags transmitting a said RF transmission of said information only when in said energized state;

means for receipt of said information contained in said RF transmission;

a computer communicating with said means for receipt of said information; and software resident in said computer, said software providing an initial identification of each said vehicle from said information, to compile a list of participants in each respective said multiple lap race and providing a means to track the progress of each said participant in said plurality of participants in each said multiple lap race, by adding an aggregate number of passes past said reading point to thereby determine a leader, based on said information received by said means for receipt of said information.

9. The system of claim 8 wherein said means for activation of said means for RF transmission comprises:

a means for determining passage of said participant past said reading point on said track;

said transmitter activated to transmit said EMF by said means for determining passage of said participant only when said participant passes said reading point;

said transmitter emitting sufficient EMF to energize said RFID tag to an energized state; and said RFID tag, when in said energized state, transmitting said information.

10. The system for automatically tracking each individual participant of a plurality of participants in a multiple lap race of toy cars around a track of claim 9, additionally comprising:

said plurality of said tracks of substantially equal dimension;

a said means for determining passage of said participant past a reading point located on each of said plurality of tracks;

said transmitter being adjacent to each said track on which each of said participants is racing;

each said transmitter activated to transmit said EMF by said means for determining passage of said participant only when said participant passes said reading point;

each said transmitter emitting sufficient EMF to energize a respective said RFID tag to an energized state; and each respective said RFID tag, when in said energized state, transmitting said information to a remote computer having software to track said participants.

* * * * *